United States Patent [19]

Cherchian et al.

[11] 4,426,013

[45] Jan. 17, 1984

[54] CAN BODY

[75] Inventors: Ara A. Cherchian, Milwaukee; Karl Elert, Brookfield; Gunther E. Ast, Milwaukee, all of Wis.

[73] Assignee: Jos. Schlitz Brewing Company, Milwaukee, Wis.

[21] Appl. No.: 42,525

[22] Filed: May 25, 1979

Related U.S. Application Data

[63] Continuation of Ser. No. 875,634, Feb. 6, 1978, abandoned, which is a continuation-in-part of Ser. No. 748,057, Dec. 6, 1976, abandoned.

[51] Int. Cl.[3] ..... B65D 7/42

[52] U.S. Cl. ..... 220/66; 220/70

[58] Field of Search ..... 220/66, 70, 453

[56] References Cited

U.S. PATENT DOCUMENTS

| | | | |
|---|---|---|---|
| 1,788,261 | 1/1931 | Werder | 220/66 X |
| 3,043,461 | 7/1962 | Glassco | 220/70 X |
| 3,360,157 | 12/1967 | Bolt et al. | 220/456 X |
| 3,979,009 | 9/1976 | Walker | 220/66 |

*Primary Examiner*—Steven M. Pollard

*Attorney, Agent, or Firm*—Andrus, Sceales, Starke & Sawall

[57] ABSTRACT

A one-piece metal can body having a cylindrical side wall and an integral bottom wall. The bottom wall is disposed in a plane normal to the axis of the cylindrical side wall and is formed with one or more outwardly extending depressions which are arranged in circular configuration and are spaced radially inwardly from the peripheral edge of the bottom wall. Under unpressurized conditions the can body rests on the depressions, and when the can body is subjected to internal pressure, the bottom wall will deform outwardly in a uniform and predictable manner and the can body will remain supported by the depressions.

1 Claim, 12 Drawing Figures

Fig. 7
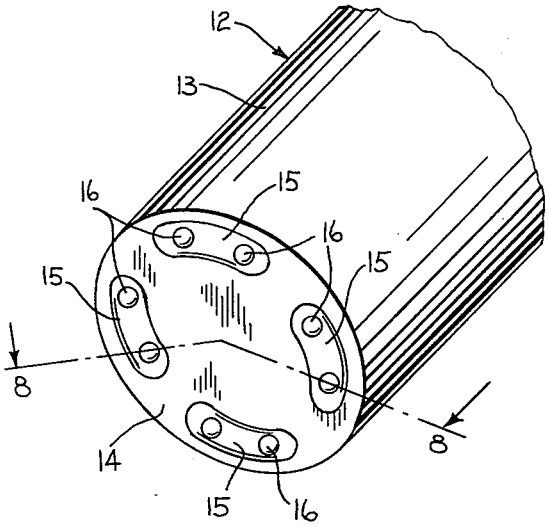
Fig. 8
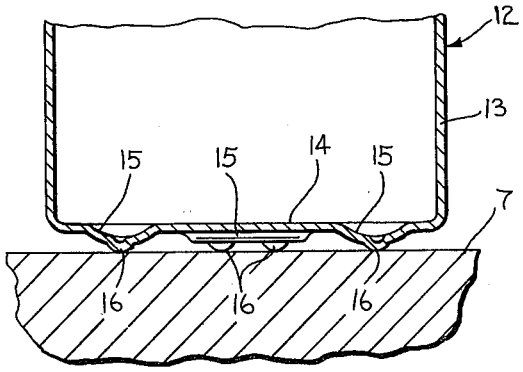
Fig. 9
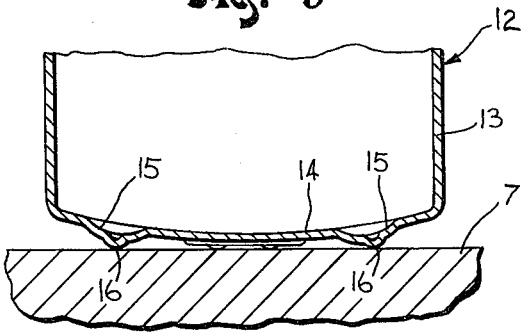
Fig. 11
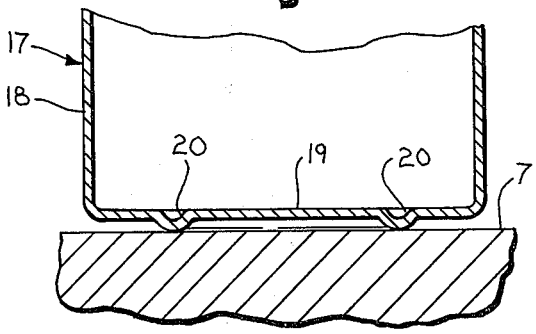
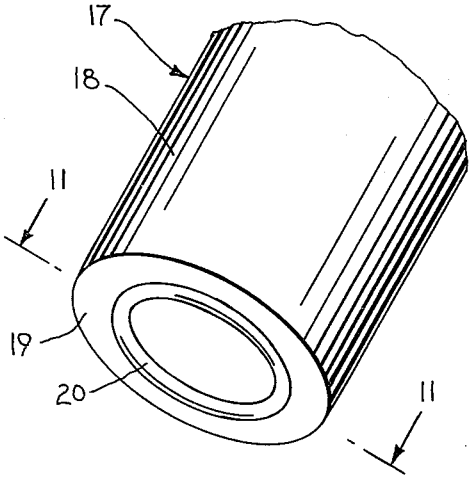
Fig. 10
Fig. 12
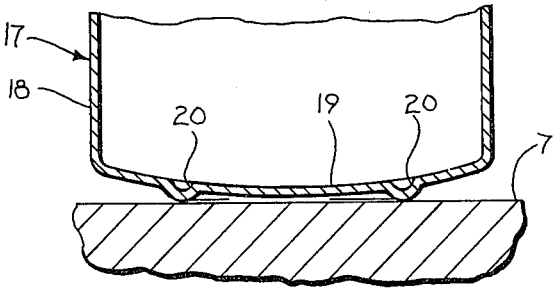

CAN BODY

This is a continuation of application Ser. No. 875,634, filed Feb. 6, 1978, which in turn is a continuation-in-part of application Ser. No. 748,057, filed Dec. 6, 1976, now abandoned.

BACKGROUND OF THE INVENTION

The conventional two-piece metal can includes a can body, composed of a generally cylindrical side wall which is formed integrally with a bottom wall, and a separate end closure or lid is used to enclose the open end of the can body. One piece can bodies constructed from a relatively ductile metal, such as aluminum or steel, are normally fabricated by a drawing and ironing operation. In the drawing and ironing operation, a disc of metal is initially drawn into the form of a relatively shallow cup, and the walls of the cup are then ironed or thinned to the desired height.

If the bottom wall of the one-piece can body is flat, or normal to the axis of the cylindrical side wall, the internal pressure exerted by the product, such as beer or carbonated beverages, may cause the bottom wall to deform or bulge outwardly into a convex configuration, thereby making the can body unstable when stored in an upright condition. Increasing the thickness of the bottom wall will resist bulging of the bottom wall, but an increase in thickness of the bottom wall also results in an increase in material and shipping costs.

In an attempt to resist the internal pressure, the bottom walls of one-piece can bodies have been formed with an upwardly extending dome or cavity, and the dome acts to resist deformation under internal pressure. However, if the internal pressure is increased beyond a critical point, the concave domed area of the container may bulge out or invert. Under such a condition, the inverted bottom of the can body provides an unstable supporting surface and increases the tendency for the can body to tip when transported by high speed conveying lines or during storage and handling. In order to prevent the inversion of the concave dome in the can bottom, the bottom walls of one-piece can bodies have been fabricated with a substantially greater thickness than the side wall. For example, while the side wall of the can body may have a thickness of about 0.005 inch, the bottom wall will have a thickness in the range of 0.015 to 0.017 inch.

A further disadvantage of the concave, domed, bottom wall construction, is the difficulty of applying the protective coating to the interior of the can body. Due to the angle at which the concavity or dome is formed, it is difficult, using standard spraying equipment, to adequately coat the interior peripheral edge of the bottom wall.

As a concave bottom wall reduces the volume of the can body, the height or diameter of the can body must necessarily be increased to compensate for the concavity.

Rather than forming the bottom wall with a configuration to resist deformation under pressure, one-piece can bodies have also been formed with a bottom wall which is designed to be deformed outwardly under internal pressure, and yet maintain a stable supporting base when deformed. Can bodies of this type are described in U.S. Pat. No. 3,904,069. In the can body as disclosed in the aforementioned patent, the bottom wall includes a central concavity or upwardly extending depression which is bordered by an annular, relatively flat, panel section. When the can body is subjected to internal pressure, the panel section deforms or bulges outwardly, but the stability of the can body is retained, due to the fact that the bottom wall is deformed into a shape having a uniform circular ring upon which the can body rests.

U.S. Pat. No. 3,979,009 shows another type of can body which is designed to permit controlled bulging or flexing under internal pressure. In the can body of patent 3,979,009, the bottom wall is formed with a flat outer peripheral section, a central concave depression and an intermediate, annular dishedsection. When the can body is pressurized, the bottom wall will then be supported by the annular ring or joint between the central depression and the intermediate section.

SUMMARY OF THE INVENTION

The invention relates to an improved, one-piece metal can body having a cylindrical side wall and an integral bottom wall. The bottom wall lies on a single plane disposed normal to the axis of the cylindrical side wall and is formed with one or more convex, or outwardly extending, depressions which are arranged in circular configuration and are spaced radially inward from the peripheral edge of the bottom wall. Under non-pressurized conditions, the can body rests on the circular depressions or ridge.

When the can body is subjected to internal pressure, the bottom wall will stretch and deform or bulge outwardly. The depth and configuration of the depressions is arranged relative to the diameter of the central portion of the bottom wall, which is the portion located radially within the depression, such that the central portion will not bulge axially beyond the outer extremities of the depressions. Thus, the depressions will retain their integrity and support the can body to thereby preserve the stability of the can body.

The can body of the invention is designed to permit, rather than resist, expansion of the bottom wall under internal pressure, while at the same time maintaining a stable supporting surface for the can body. Thus, the bottom wall can be formed of thinner metal than that of can bodies which are designed to resist expansion or inversion.

The flat bottom wall of the can body of the invention will deform to a lesser degree under a given internal pressure than prior types of can bodies of the same wall thickness but utilizing concave bottom walls, and at the same time will retain its stability under all normally-encountered pressure conditions. When pressurized, the depressions and the central portion of the bottom wall both deflect at approximately the same rate under all operating pressures, thereby insuring that the depressions will at all times constitute the supporting surface for the can body.

The convex depressions in the bottom wall can be formed with existing forming equipment during the ironing operation so that no additional equipment is required in order to provide the structure of the invention.

Other objects and advantages will appear in the course of the following description.

DESCRIPTION OF THE DRAWINGS

The drawings illustrate the best mode presently contemplated of carrying out the invention.

In the drawings:

FIG. 7 is a perspective view of a further modified form of the can body of the invention;

FIG. 8 is a vertical section of the can body of FIG. 7 in a non-pressurized condition;

FIG. 9 is a view similar to FIG. 8 showing the can body in a pressurized condition;

FIG. 10 is a perspective view showing the bottom of a further modified form of the can body of the invention;

FIG. 11 is a vertical section of the can body of FIG. 10 in a non-pressurized condition; and FIG. 12 is a view similar to FIG. 11 showing the can body in a pressurized condition.

DESCRIPTION OF THE PREFERRED EMBODIMENT

Figure 1:
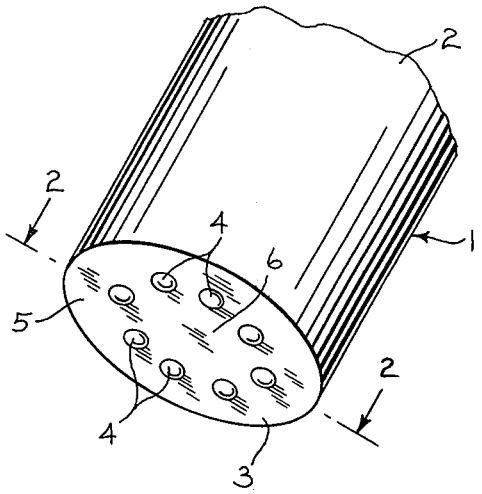
FIG. 1 is a perspective view of a can body incorporating the invention.
Figure 2:
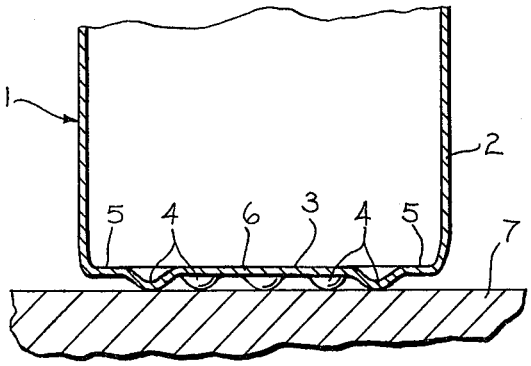
FIG. 2 is a vertical section of the can body of FIG. 1 in a non-pressurized condition.
Figure 3:
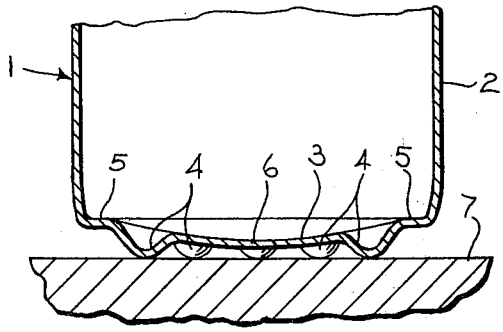
FIG. 3 is a view similar to FIG. 2 showing the configuration of the bottom wall when the can body is subjected to internal pressure.

FIGS. 1–3 illustrate a one-piece metallic can body 1 formed by a drawing and ironing operation and which includes a generally cylindrical side wall 2, an integral bottom wall 3 and an open top. The side wall 2 and bottom wall 3 have a substantially uniform wall thickness, generally in the range of about 0.005 to 0.012 inch. As illustrated in FIG. 1, the bottom wall 3 is formed with a plurality of downwardly extending depressions or dimples 4 which are arranged in a generally circular configuration. Under unpressurized conditions, as shown in FIG. 2, the outer marginal area 5, located between the depressions 4 and the periphery of the bottom wall, and the central area 6, within the depressions 4, lie in a plane which is substantially normal to the axis of the cylindrical side wall 2. The depressions 4 provide a generally circular support which supports the can body in an upright condition on a surface 7.

When the can body is subjected to internal pressure, the bottom wall 3 will deform or bulge downwardly, as illustrated in FIG. 3. Under the pressurized condition, the annular outer section 4 will deform downwardly and similarly, the central area 5 and depressions 4 will deform downwardly. However, the depressions 4 will retain their integrity so that the can body will be supported on the ring of depressions and the can body will remain stable. Due to the construction of the bottom wall, the outward deformation of the depressions 4 and central area 6 will be approximately the same as the can body is pressurized. This equalized rate of deformation insures that the depressions or dimples 4 will at all times constitute the support for the upright can and the central area 6 will be out of contact with the surface 7, as shown in FIG. 3.

The circular arrangement of the depressions 4 can be located relatively close to the outer periphery of the bottom wall 3 to achieve greater stability for the can body. This provides a substantial improvement over the can body of the type shown in U.S. Pat. No. 3,904,069, for if the diameter of the circular support of that can body is increased, the tendency for the central concavity or dome to invert under pressure is correspondingly increased.

It is preferred to use at least eight dimples 4 in the can bottom 3, so that if the periphery of the can body should overhang the edge of a conveyor when being conveyed, the can body will still be supported in the upright condition by a number of the dimples.

Figure 4:
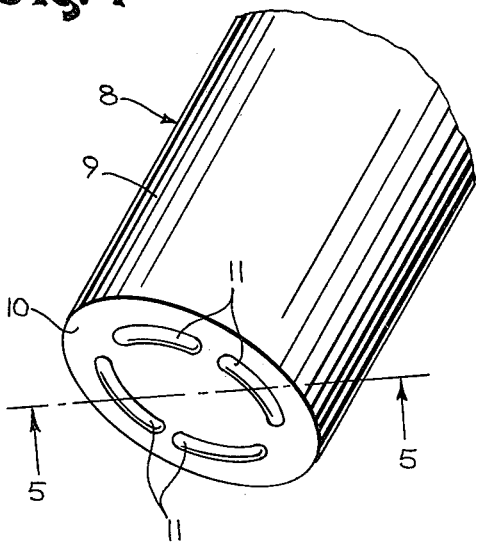
FIG. 4 is a perspective view showing the bottom wall of a modified form of the can body of the invention.
Figure 5:
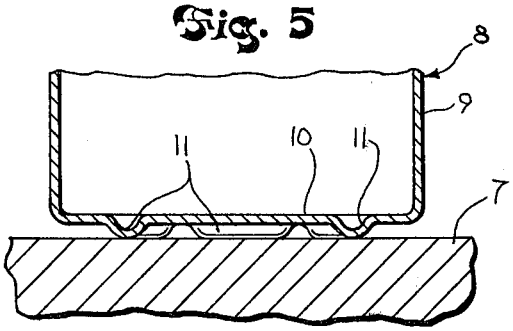
FIG. 5 is a vertical section of the can body of FIG. 4 in a non-pressurized condition.
Figure 6:
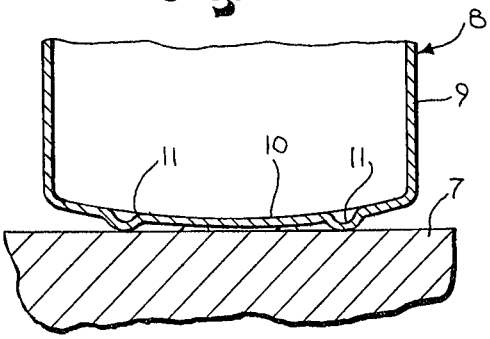
FIG. 6 is a view similar to FIG. 5 showing the can body in a pressurized condition.

FIGS. 4–6 illustrate a modified form of the invention in which the one-piece can body 8 includes a cylindrical side wall 9 and an integral bottom wall 10 which lies in a plane normal to the axis of the can body. In this embodiment, a series of generally arcuate, convex, depressions 11, similar in function to depressions 4, are formed in the bottom wall. The depressions 11 are arranged in a generally circular pattern and when the can body is subjected to internal pressure, as shown in FIG. 6, the bottom wall 10 will bulge outwardly, but depressions 11 will maintain their configuration to preserve the stability of the upright can body.

FIGS. 7–9 show a further modified form of the invention. In this embodiment, the can body 12 includes a cylindrical side wall 13 and an integral bottom wall 14 which is disposed normal to the axis of the can body. A plurality of generally arcuate, convex depressions or ridges 15 are arranged in a generally circular pattern in the bottom 14, and each depression 15 has one or more outwardly projecting dimples 16. When utilizing relatively hard metals or alloys in fabricating the can body, the dimples 16 facilitate the forming operation and decrease the tendency for the metal to split or rupture. The use of two dimples 16 in conjunction with each depression 15 increases the stability of the can body under pressurized conditions.

In the unpressurized condition, as shown in FIG. 8, the can body 12 is supported on the dimples 16, and when the can body is pressurized due to the pressure of the pressurized contained product, the bottom wall 14 will be deformed outwardly as shown in FIG. 9, and the can body will continue to be supported on the dimples 16. The depressions 15 and dimples 16 retain their integrity, or general configuration, under the pressurized conditions.

FIGS. 10–12 illustrate a further modified form of the invention in which the one-piece can body 17 includes a cylindrical side wall 18 and an integral bottom wall 19 which is disposed normal to the axis of the can body. In this embodiment the bottom wall 19 is formed with a continuous, generally circular, downwardly extending depression 20.

When the can body 17 is pressurized, the outer annular area 12 as well as the central area 14 will be deformed outwardly to the position shown in FIG. 12, so that in the pressurized condition, the can body will continue to be supported on the annular depression 20.

The one-piece can body of the invention can be formed by conventional drawing and ironing techniques. In the method of fabrication, a disc of aluminum alloy or steel, is initially drawn to the form of a shallow-cup and redrawn to reduce the diameter of the cup to approximately the finished diameter. The cup is then ironed to reduce and elongate the side wall and the convex depressions are formed in the bottom wall at the final stage of the multiple ironing process.

The can body of the invention permits the bottom wall to deform or deflect outwardly under pressure while maintaining a stable support. Because the bottom is not designed to resist deformation under pressure, the thickness of the bottom wall can be reduced substantially over can bodies in which the bottom is configured to resist expansion.

Various modes of carrying out the invention are contemplated as being within the scope of the following claims particularly pointing out and distinctly claiming the subject matter which is regarded as the invention.

We claim:

1. A one-piece metallic can body for use in a can for a substance susceptable of generating substantial internal pressure, comprising integral side and bottom walls, the side wall being cylindrical and the bottom wall in its completed unpressurized state being substantially flat, and being adapted to bow outwardly a substantial distance in response to internal pressure generated within the can after it has been completed and filled.

said bottom wall having portions projecting downwardly, away from the can interior, at a plurality of locations surrounding the central region of the bottom wall, the locations being spaced inwardly from the cylindrical side wall and disposed along a circle which is substantially coaxial with the central longitudinal axis of the can body, wherein the annular peripheral region of the bottom wall disposed radially outward of said circle is disposed in a common plane with said central region when the can body is in a completed non-pressurized condition, the projections serving as the support members for the can body, with predetermined points on said projections serving as the contact points to a support surface, when the bottom wall is in its normal substantially flat state, and said projections also serving as the support members for the can body, with said predetermined points on said projections serving as the contact points, to provide a stable support surface for the can body, when the bottom wall is bowed outwardly a substantial distance beyond its normal state under the force of said internal pressure.

* * * * *